US006701739B2

(12) United States Patent
Morse

(10) Patent No.: US 6,701,739 B2
(45) Date of Patent: Mar. 9, 2004

(54) MODULAR REFRIGERATION SYSTEM FOR REFRIGERATION APPLIANCE

(75) Inventor: Robert L. Morse, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 53 days.

(21) Appl. No.: 10/167,919

(22) Filed: Jun. 12, 2002

(65) Prior Publication Data

US 2003/0230104 A1 Dec. 18, 2003

(51) Int. Cl.[7] ..... F25B 47/00; F25B 19/02

(52) U.S. Cl. ..... 62/277; 62/448; 62/440; 62/450; 62/298; 62/515

(58) Field of Search ..... 62/440, 448, 450, 62/298, 277, 515

(56) References Cited

U.S. PATENT DOCUMENTS

| | | | | | |
|---|---|---|---|---|---|
| 2,344,706 | A | | 3/1944 | Kucher | 257/3 |
| 2,708,835 | A | | 5/1955 | Nigro | 62/140 |
| 2,736,176 | A | | 2/1956 | Carlton | 62/129 |
| 3,031,862 | A | | 5/1962 | Sherron | 62/259 |
| 3,415,073 | A | | 12/1968 | Ammons | 62/259 |
| 3,433,031 | A | | 3/1969 | Scheitlin et al. | 62/448 |
| 3,712,078 | A | | 1/1973 | Maynard et al. | 62/448 |
| 3,724,233 | A | | 4/1973 | Pugh et al. | 62/285 |
| 4,019,339 | A | | 4/1977 | Anderson | 62/255 |
| 4,076,073 | A | | 2/1978 | Yamamoto et al. | 165/53 |
| 4,118,083 | A | | 10/1978 | Lackey et al. | 312/100 |
| 4,471,633 | A | | 9/1984 | Tinsler | 62/295 |
| 4,920,764 | A | | 5/1990 | Martin | 62/259.1 |
| 4,977,750 | A | | 12/1990 | Metcalfe | 62/77 |
| 5,088,299 | A | | 2/1992 | Peterson | 62/298 |
| 5,199,273 | A | | 4/1993 | Silva et al. | 62/298 |
| 5,222,372 | A | | 6/1993 | DeRees et al. | 62/237 |
| 5,284,023 | A | | 2/1994 | Silva et al. | 62/77 |
| 5,347,827 | A | | 9/1994 | Rudick et al. | 62/440 |
| 5,402,654 | A | | 4/1995 | Rudick et al. | 62/448 |
| 5,417,079 | A | | 5/1995 | Rudick et al. | 62/253 |
| 5,417,081 | A | | 5/1995 | Rudick et al. | 62/440 |
| 5,437,164 | A | | 8/1995 | Consiglio | 62/259.1 |
| 5,622,058 | A | | 4/1997 | Ramakrishnan et al. | 62/295 |
| 5,678,421 | A | | 10/1997 | Maynard et al. | 62/407 |
| 5,697,227 | A | | 12/1997 | Bruce et al. | 62/285 |
| 5,722,244 | A | * | 3/1998 | Shelton | 62/74 |
| 5,732,565 | A | | 3/1998 | Ramakrishnan et al. | 62/298 |
| 5,924,300 | A | | 7/1999 | Fromm et al. | 62/259.1 |
| 5,941,092 | A | | 8/1999 | Tosaki et al. | 62/428 |
| 5,953,929 | A | | 9/1999 | Bauman et al. | 62/259.1 |
| 6,070,424 | A | * | 6/2000 | Bauman et al. | 62/279 |
| 6,082,131 | A | * | 7/2000 | Hirosawa et al. | 62/448 |
| 6,094,934 | A | * | 8/2000 | Rand et al. | 62/440 |
| 6,350,002 | B1 | * | 2/2002 | Takaoka et al. | 312/407 |

* cited by examiner

*Primary Examiner*—William C. Doerrler
*Assistant Examiner*—Mark Shulman
(74) *Attorney, Agent, or Firm*—Baker & Daniels

(57) ABSTRACT

A modular refrigeration system having an evaporator, a condenser, a compressor, and expansion device fluidly connected by a plurality of conduits. The modular refrigeration system includes an integral base plate to which the evaporator, condenser, expansion device, and compressor are mounted. A compressor mount is formed in the base plate and includes at least one integrally formed stud extending from the base plate. The compressor has at least one mounting flange in which the stud is received. A fastener is affixed to the stud to secure the compressor to the base plate. A drain pan is formed in the base plate beneath the compressor to collect condensate. A drain basin is located beneath the evaporator and is fluidly connected to the drain pan via a trough. Condensate from the evaporator drains to the drain pan where it is evaporated.

21 Claims, 10 Drawing Sheets

MODULAR REFRIGERATION SYSTEM FOR REFRIGERATION APPLIANCE

BACKGROUND OF THE INVENTION

The present invention relates to refrigeration appliances and more particularly to those having a modular refrigeration system.

Conventionally, refrigeration appliances are provided with a refrigeration system to cool the interior thereof One such refrigeration appliance may include, e.g., a vending machine, refrigerator or freezer case, or the like. The refrigeration system typically includes a compressor, evaporator, condenser, and expansion device fluidly connected by a plurality of conduits. The system also includes control electronics for operation of the system.

Some refrigeration appliances include a refrigeration system having the components thereof individually mounted within the appliance. In the case of failure of one of the components, the malfunctioning component must be replaced. In order to repair the system, the refrigerant charge in the failed component and the conduits interconnecting the component to the system must be removed. The component is replaced and the system is then recharged with refrigerant.

A problem with this type of system is that if the component is replaced on site, the repair could be time consuming and messy, and require a substantial amount of equipment to be brought to the job site to effect the repair. If the entire refrigeration appliance is taken off-site to be repaired, the time necessary to complete the repair and return the appliance may be substantial. The cost of the repair and travel time is also significant.

In other types of refrigeration appliances, several of the refrigeration system components may be mounted to a base which is removably mounted in the lower end of the appliance. The base of the refrigeration system may be provided with a condensate pan located beneath the condenser in which condensate produced during operation of the refrigeration system collects. The condensate is then caused to evaporate by directing air over the pan. Additionally, the discharge conduit from the compressor may be located at least partially in the pan to assist with the evaporation process. One particular base plate of the prior art is formed from several layers of material.

A problem with this type of refrigeration system is that with the condensate pan being located beneath the condenser, the evaporation of the condensate takes more time as the condenser fan is not directly blowing warm air over the pan. Further, with the base being formed of several layers the assembly time and thus the cost of the system is increased.

It is desired to provide a modular refrigeration system which is a removable and replaceable unit providing faster boil off of collected condensate and an improved base plate for the unit.

SUMMARY OF THE INVENTION

The present invention relates to an integrated, modular refrigeration system having a compressor, evaporator, condenser, expansion device, conduits, and control electronics assembled onto a base which is installed into a refrigeration appliance, such as, e.g., a vending machine. In the event of component failure, the refrigeration system unit may be removed and a new one used to replace the unit. The failed component in the removed system is then later replaced to refurbish the system for use in another refrigeration appliance. The refrigeration system is slid into and out of the appliance as a unit, with the only installation steps including connecting the electrical power and control connections.

The present invention includes a one-piece molded base plate to which all of the refrigeration system components are mounted. The base plate includes integrally formed bosses and studs for mounting the compressor to the plate. The compressor includes mounting feet which rest upon the bosses, positioning the compressor above the condensate pan formed beneath the compressor. The mounting feet include apertures through which the mounting studs extend. A push on nut is placed on the stud to secure the compressor to the base plate. The other components may be mounted to the base plate using fasteners such as screws, or the like.

The evaporator is mounted to a one-piece evaporator mount secured to the base plate. The evaporator core is attached to the evaporator mount which includes an integral drain where condensate collects and delivers it to a common point such as a drain basin formed in the base plate. The condensate from the evaporator mount collects in the drain basin integrally formed in the base plate and is directed to the drain pan located beneath the compressor by a trough also formed in the base plate.

The discharge tube from the compressor is located within the drain pan to assist in the rapid boil off of water collected therein. Air heated by and drawn through the condenser is blown across the surface of the condensate to further assist in evaporation from the drain pan. An integral evaporator fan motor mount is provided in the base plate as well as integral airflow holes through which air enters and exits the chamber defined by an evaporator cover.

The evaporator cover encloses the evaporator core. The cover is insulated, being provided with a smooth plastic inner liner in direct contact with the refrigerated air. The liner has large radii so as not to disrupt the flow of air along the inner surface of the cover. A molded foam outer liner having a variable thickness is located over the smooth plastic inner liner. Projections are molded into the base plate which fit into the inner perimeter corners of the interior liner at the open end of the cover to maintain the position of the cover on the base plate. A groove is provided in the outer surfaces of the top and the sides in which a large rubber band is provided. The end of the rubber band is stretched over the cover and is looped around hooks formed in the base plate to retain the position of the evaporator cover.

The present invention provides a modular refrigeration system having an evaporator, a condenser, and a compressor fluidly connected by a plurality of conduits. The modular refrigeration system includes a one-piece base plate with the evaporator, condenser, and compressor mounted thereto. A compressor mount is formed in the base plate and includes at least one integrally formed stud extending therefrom. The compressor has at least one mounting flange with an aperture formed therein in which the stud is received. A fastener is affixed to the stud to secure the compressor to the base plate.

The present invention also provides a modular refrigeration system having an evaporator, a condenser, and a compressor fluidly connected by a plurality of conduits. The modular refrigeration system includes a one-piece base plate having the evaporator, condenser, and compressor mounted thereto. A drain pan is integrally formed in the base plate located beneath the compressor. A drain basin is integrally formed in the base plate located beneath the evaporator. The basin and the drain pan are fluidly connected such that condensate collects in the drain pan.

The present invention further provides a modular refrigeration system having an evaporator, a condenser, and a compressor fluidly connected by a plurality of conduits. The modular refrigeration system includes a one-piece base plate having the evaporator, condenser, and compressor mounted thereto. A drain pan is integrally formed in the base plate located beneath the compressor in which condensate collects. The condenser further includes a fan which directs air over the drain pan to evaporate the condensate. A fan mount is integrally formed in the base plate located beneath the evaporator. At least one airflow passageway is located in the base plate. A cover is mounted to the base plate encasing the evaporator with the fan mount and the airflow passageway being located beneath the cover.

The present invention provides a modular refrigeration system having an evaporator, a condenser, and a compressor fluidly connected by a plurality of conduits. The modular refrigeration system includes a one-piece base plate to which the evaporator, condenser, and compressor are mounted. At least one projection is integrally formed with the base plate and engages a cover mounted to the base plate to encase the evaporator. A groove is formed in cover. A hook is located on each of opposite sides of the base plate. An elastic fastener is received in the groove and engages each of the hooks to secure the cover to the base plate.

The present invention also provides a method of attaching a cover for an evaporator to a base plate of a modular refrigeration system including engaging the cover with projections extending from the base plate; engaging a first hook formed on a first side of the base plate with an elastic fastener; locating the elastic fastener in a groove formed in the cover; and engaging a second hook formed on a second, opposite side of the base plate with the elastic fastener, whereby the cover is secured to the base plate.

One advantage of the present invention is that the modular unit facilitates quick and easy repair of the refrigeration appliances and simplifies assembly of the appliance at the OEM.

An additional advantage of the present invention is the integrally formed base plate which is easily constructed and cost effective.

A further advantage of the present invention is the method of mounting the evaporator cover to the base plate. The projections in the base plate allow for alignment of the cover over the evaporator with the elastic fastener being quickly and easily removable and replaceable in the case of system refurbishment and repair.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
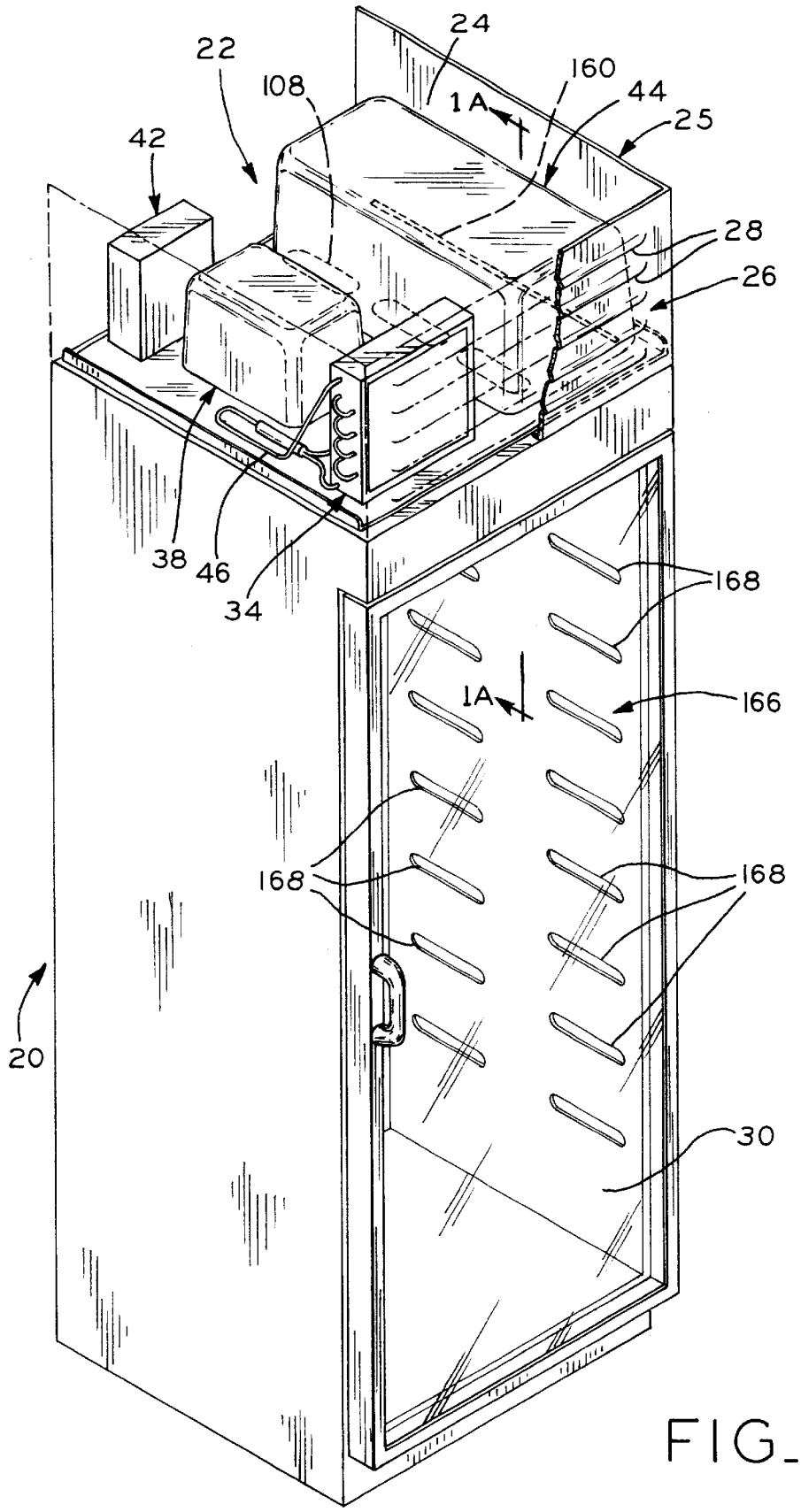
FIG. 1 is a perspective view of a refrigeration apparatus having a modular refrigeration system in accordance with the present invention.

Corresponding reference characters indicate corresponding parts throughout the several views. Although the drawings represent an embodiment of the present invention, the drawings are not necessarily to scale and certain features may be exaggerated in order to better illustrate and explain the present invention.

DETAILED DESCRIPTION OF THE INVENTION

Figure 1A:
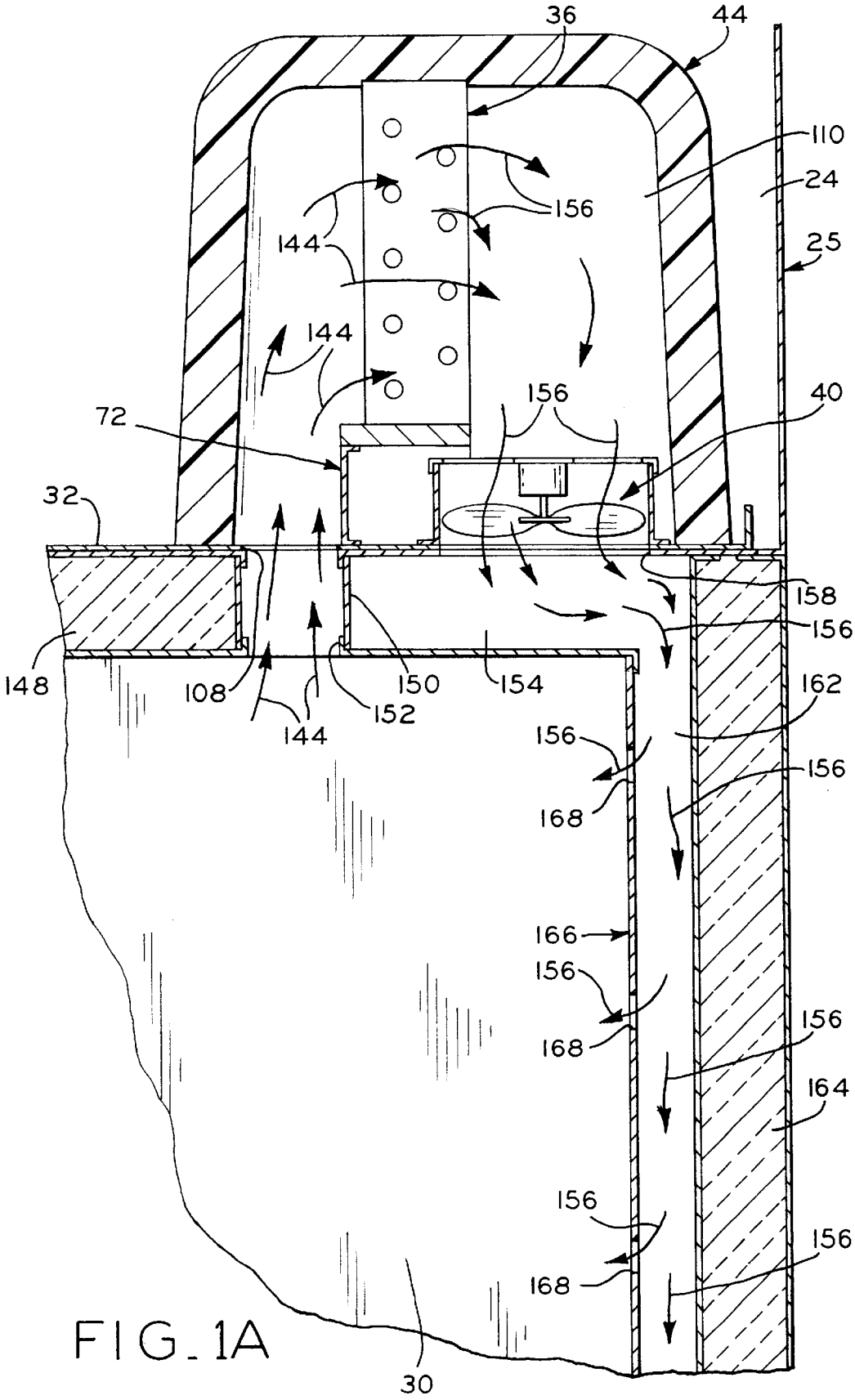
FIG. 1A is a sectional view of the refrigeration apparatus of FIG. 1 taken along line 1A—1A.

Referring to FIGS. 1 and 1A, refrigeration appliance 20 may be, e.g., a vending machine, refrigerator or freezer case, or the like. Refrigeration appliance 20 is provided with modular refrigeration system 22 which is an integrated, packaged unit mounted in upper compartment 24 of appliance 22. Upper compartment 24 is defined by cover 25 which has three sides. The top and rear of cover 25 are open so that modular refrigeration system 22 may be slidably installed and removed as necessary. Cover 25 is provided with front vent panel 26 having louvers 28 therein through which air may enter and exit the compartment. Modular refrigeration system 22 is mounted to the upper end of compartment 30 located below compartment 24. Lower compartment 30 is the cooled or refrigerated portion of appliance 20.

Figure 2:
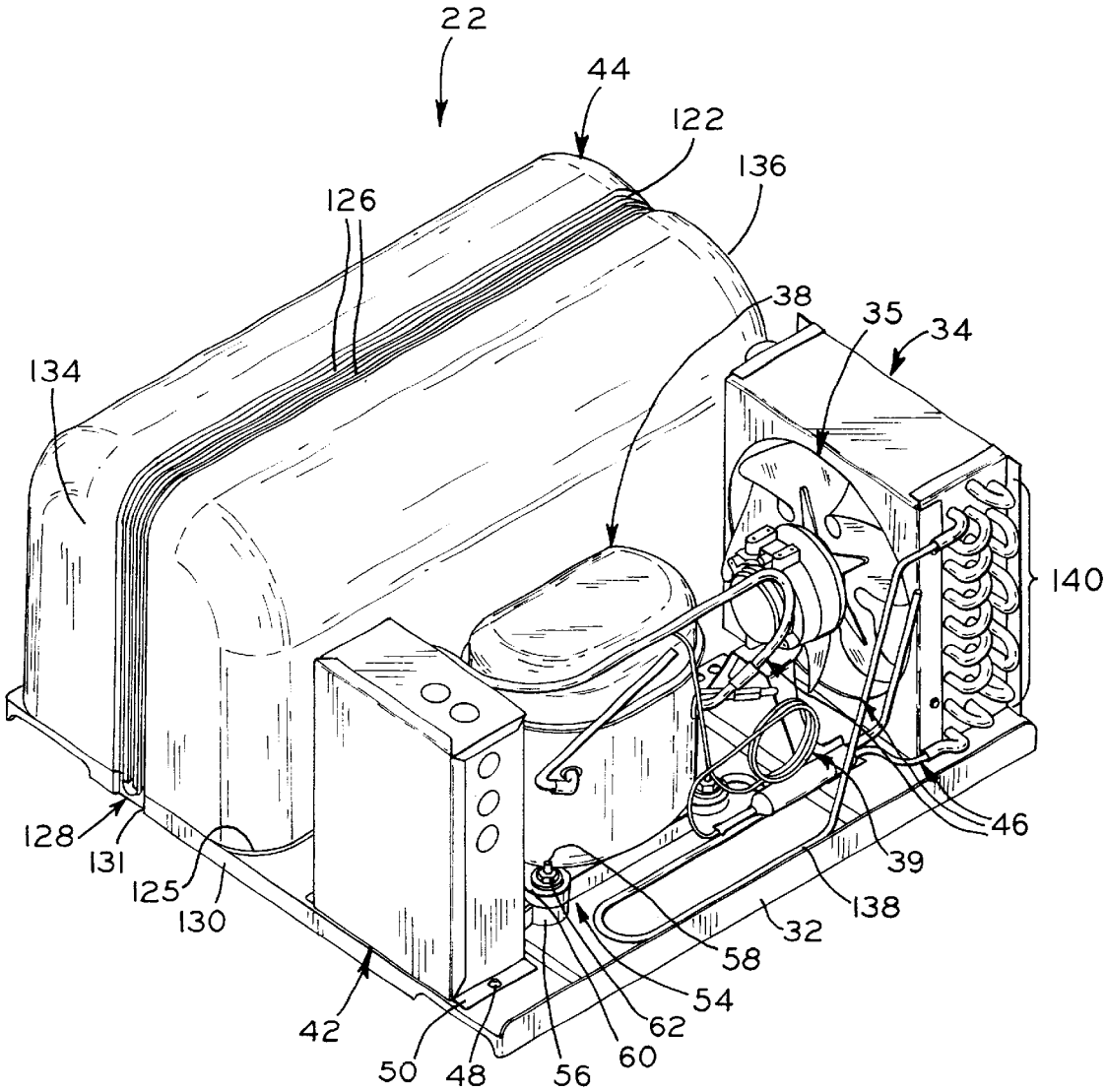
FIG. 2 is a perspective view of the modular refrigeration system of the present invention.
Figure 3:
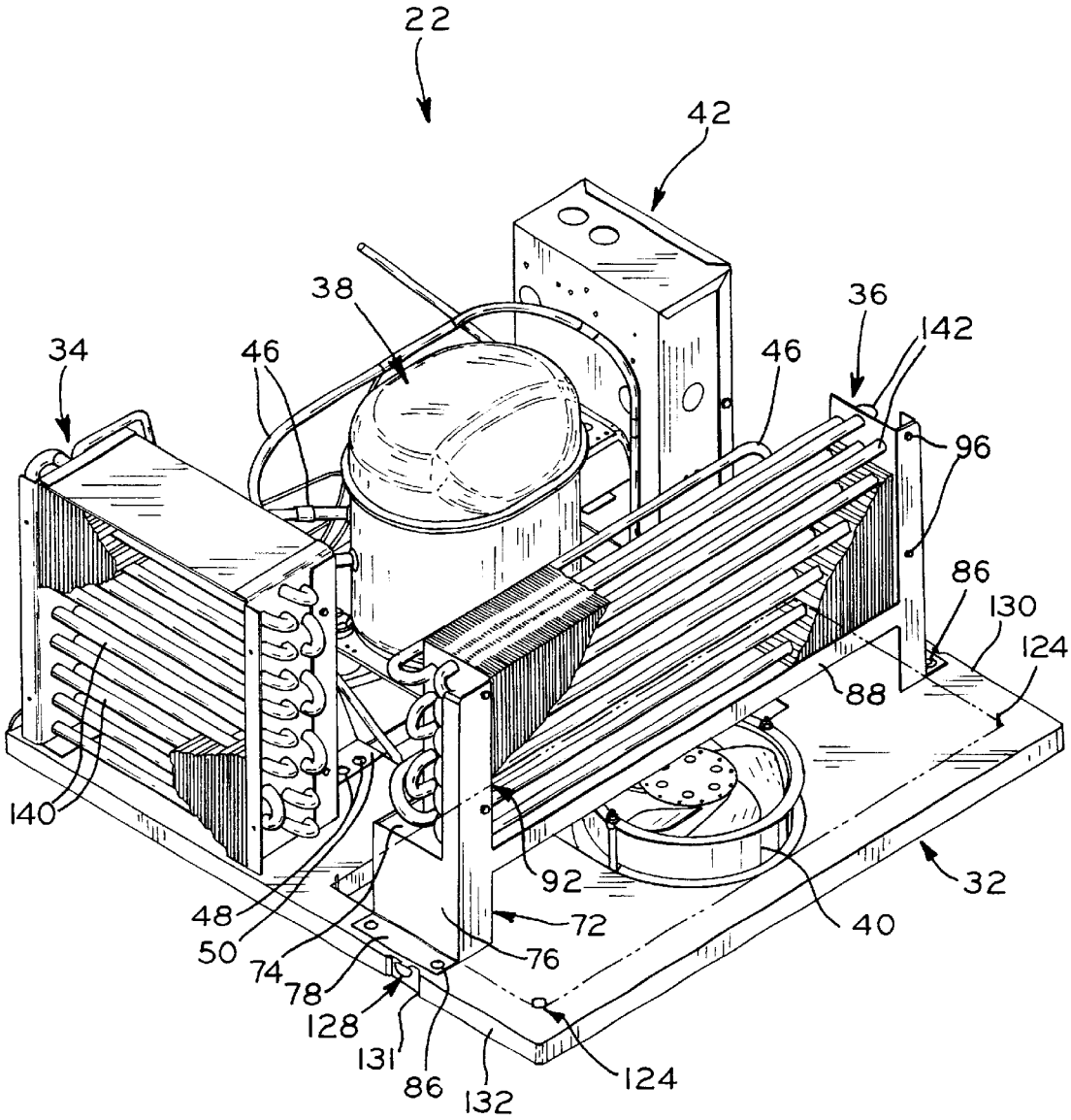
FIG. 3 is a perspective view of the modular refrigeration system of FIG. 2, with the evaporator cover removed.

Referring to FIGS. 2 and 3, modular refrigeration system 22 is a unit having base plate 32 onto which condenser assembly 34 including condenser fan 35, evaporator 36, compressor 38, expansion device 39, fan 40, and electrical control box 42 are mounted. Cover 44 is secured to base plate 32 to encase evaporator 36 and fan 40. Conduits 46 fluidly connect the refrigeration system components. With the components interconnected by conduits 46, system 22 is initially charged with refrigerant prior to being shipped to the OEM which facilitates quick and easy assembly of refrigeration appliance 20.

Refrigeration system 22 may be slidably removed from and replaced in appliance 20 as a unit. For example, in the case of component failure, the failed refrigeration system unit 22 is removed from appliance 20 and a second refrigeration system unit 22 is installed. The installation of a working unit 22 is quick and easy with only an electrical connection to a power source and any control connections needing to be made. The removed unit 22 is refurbished by removing and replacing the failed component off-site. The refurbished system is then recharged with refrigerant and used to replace another unit 22 if necessary.

Referring to FIGS. 4, 5, 6, and 7, refrigeration system 22 includes one piece, integrally formed base plate 32. Base plate 32 is formed by any suitable method including injection molding, pressure molding, casting, or the like and is constructed from a material such as plastic, reinforced plastic, or lightweight metals such as aluminum.

As illustrated in FIGS. 2, 3, 4, and 5, condenser 34 assembly and electrical control box 42 are mounted to base plate 32, adjacent compressor 38, by any suitable type of fasteners 48 such as screws. Fasteners 48 are received in apertures formed mounting feet 50 of condenser assembly 34 and electrical control box 42 and engage apertures 52 formed in plate 32 to secure the components thereto.

Base plate 32 is provided with integral compressor mount 54 for mounting compressor 38 thereto. Referring to FIGS. 4, 5, 6, and 7, compressor mount 54 is formed with four bosses 56 having integral studs 58 extending upwardly therefrom and integrally formed therewith. Bosses 56 are positioned to align with mounting feet 60 (FIG. 2) integrally formed with the compressor housing such that studs 58 are received in apertures located in feet 60. As shown in FIG. 2, one fastener 62 is secured to the end of each stud 58 to secure compressor 38 into position on base plate 32. Fasteners 62 may be any suitable type of nut such as, e.g., a pal nut or push nut.

Compressor mount 54 is located in condensate drain pan 64 integrally formed in base plate 32 directly beneath compressor 38. Bosses 56 extend upwardly from lower surface 66 of drain pan 64 a predetermined distance. Mounting feet 60 of compressor 38 engage the upper surface of bosses 56 to locate compressor 38 above the maximum condensate level in drain pan 64. Condensate drain pan 64 is in fluid communication with drain basin 68 located beneath evaporator 36 by channel or trough 70. Drain basin 68 and trough 70 are integrally formed in base plate 32.

Referring to FIGS. 3, 8, 9, 10, and 11, evaporator 36 is mounted to base plate 32 via evaporator mount 72. Evaporator mount 72 is constructed from any suitable material able to support evaporator 36 by a method such as molding or casting, for example. Evaporator mount 72 includes substantially horizontal support platform 74 having substantially vertical legs 76. Located at the bottom of legs 76 are mounting feet 78 which extend substantially perpendicularly from legs 76. Mounting feet 78 are received in recesses 80 (FIG. 4) integrally formed in base plate 32 having apertures 82 located therein. Apertures 84 formed in mounting feet 78 align with apertures 82 to receive fasteners 86 (FIG. 3) to secure evaporator mount 72 to base plate 32. Located about the periphery of support platform 74 is lip 88 which defines drip pan 90 for condensate produced by evaporator 36. Extending upwardly from support platform 74 near the rear comers thereof are braces 92. Braces 92 are provided with apertures 94 which align with apertures in evaporator 36. Fasteners 96 are received by apertures 94 and those in evaporator 36 to secure evaporator 36 to mount 72.

Figure 10:
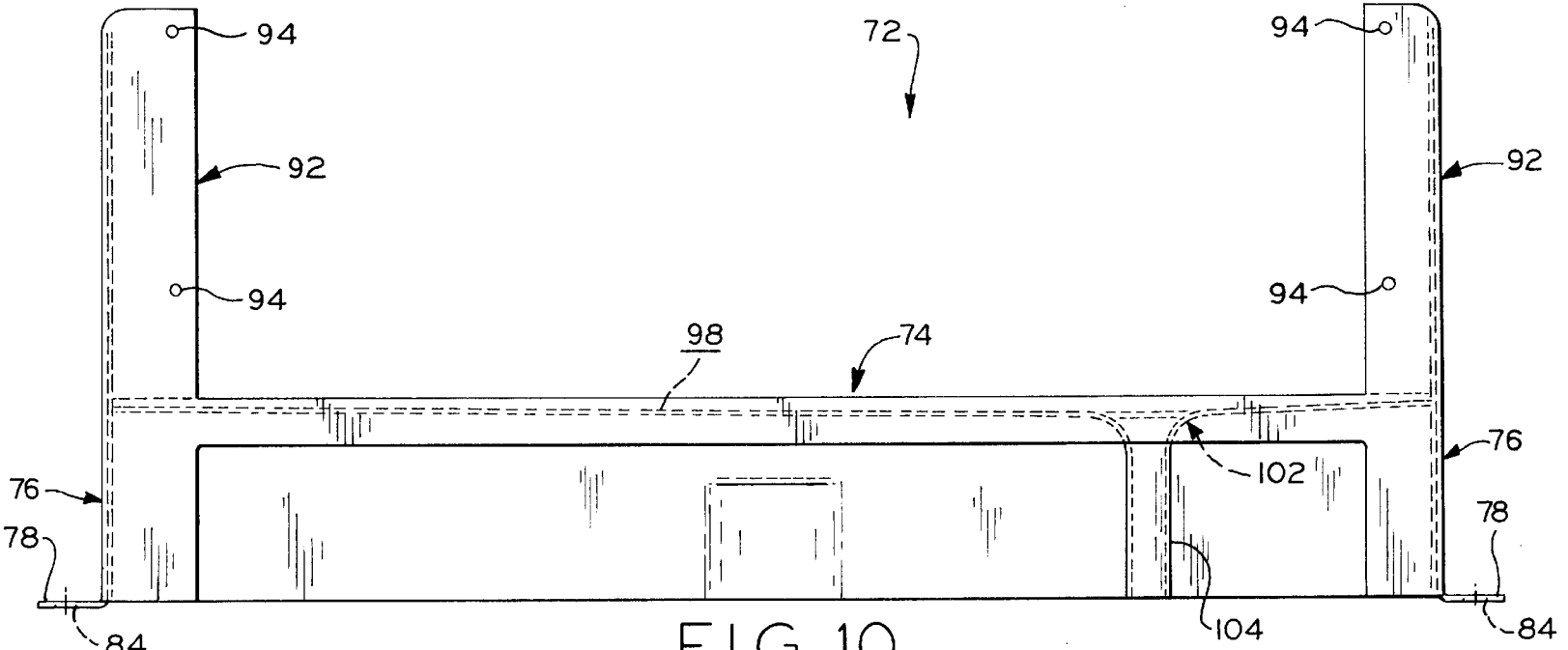
FIG. 10 is a side elevational view of the evaporator mount of FIG. 8.
Figure 11:
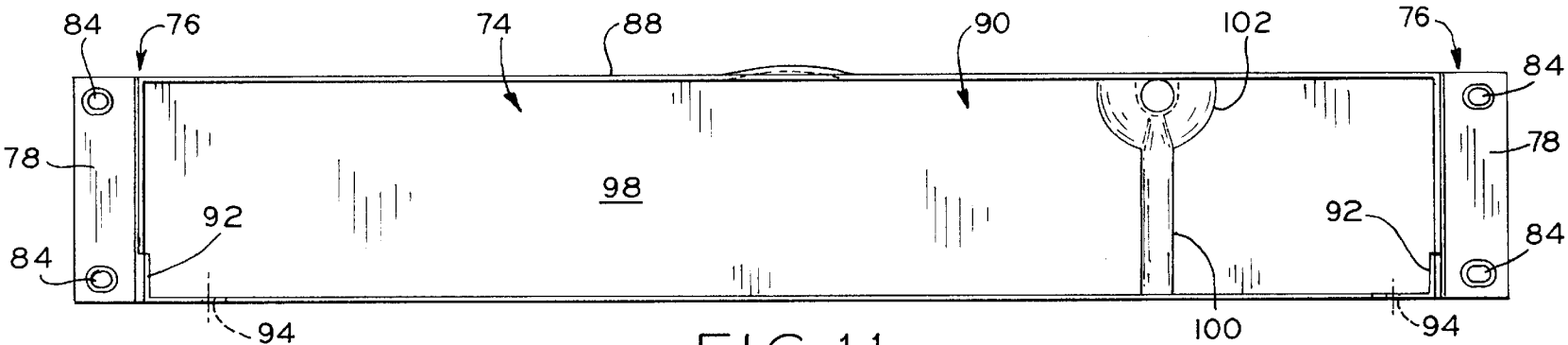
FIG. 11 is to view of the evaporator mount of FIG. 8.

Referring to FIG. 10, drip pan 90 is defined by upper surface 98 of support platform 74 and lip 88. Integrally formed in support platform 74 is channel 100. Upper surface 98 of support platform 74 is downwardly inclined toward channel 100 to direct evaporator condensate produced during operation of refrigeration system 22 toward the channel. From channel 100, the condensate enters funnel shaped drain 102 and travels along passageway 104 to collect in drain basin 68 (FIG. 4).

Figure 4:
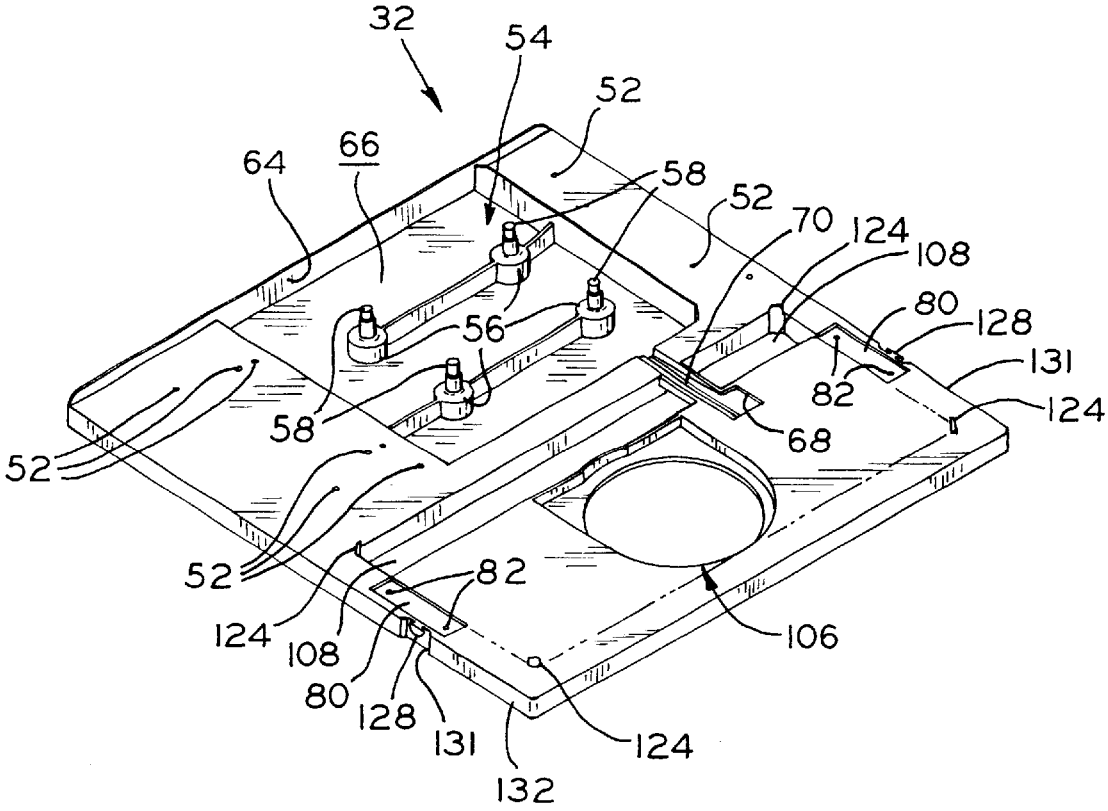
FIG. 4 is a perspective view of a base plate of the modular refrigeration system of the present invention.
Figure 7:
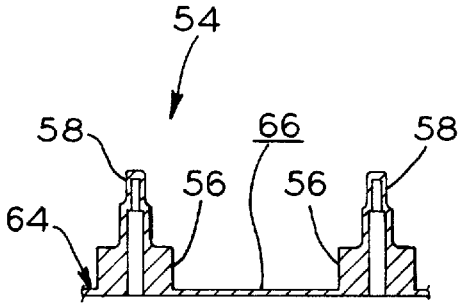
FIG. 7 is a sectional view of a compressor mounting area in the base plate of FIG. 6 taken along line 7—7.
Figure 5:
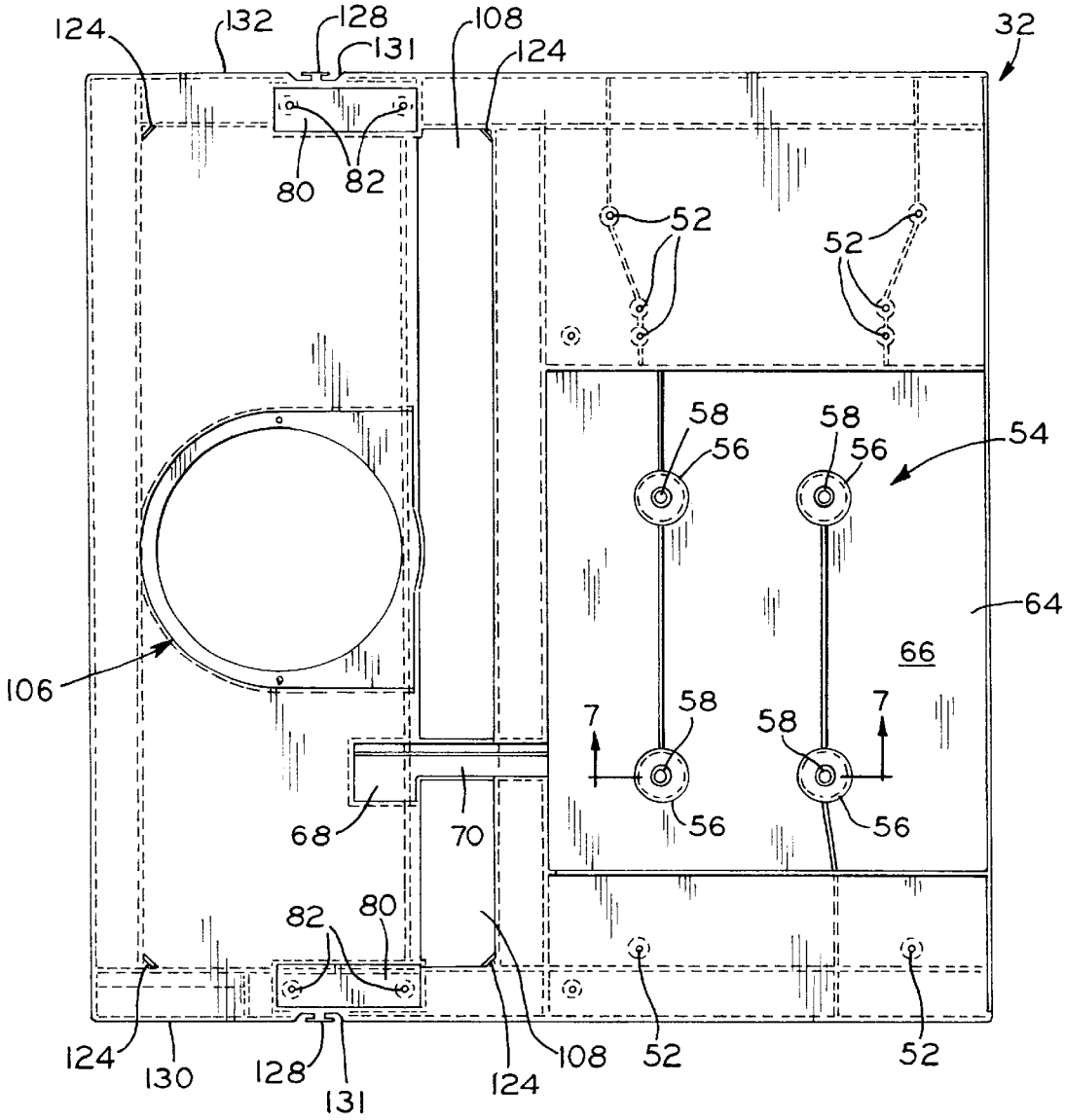
FIG. 5 is a top plan view of the base plate of FIG. 4.
Figure 6:
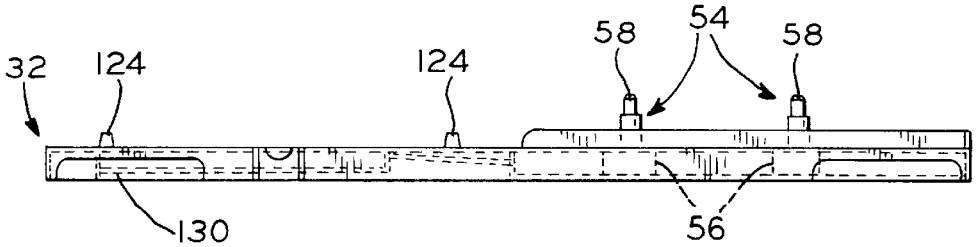
FIG. 6 is a side elevational view of the base plate of FIG. 4.
Figure 8:
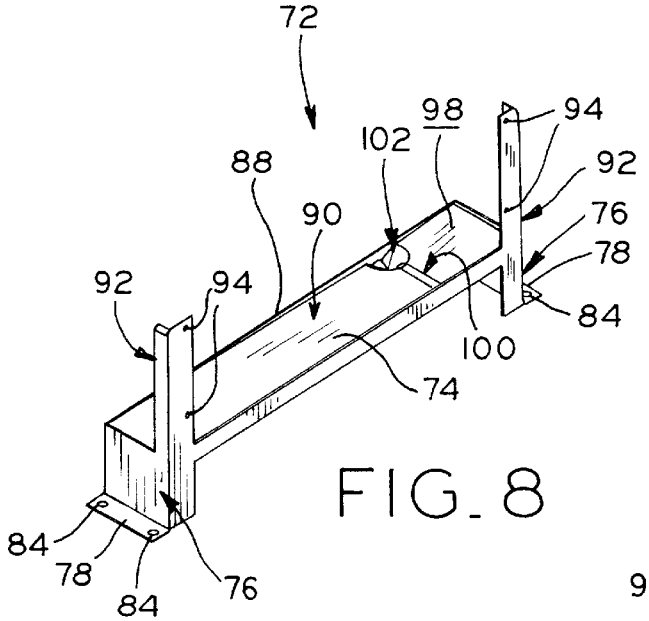
FIG. 8 is a perspective view of an evaporator mount of the modular refrigeration system of the present invention.
Figure 9:
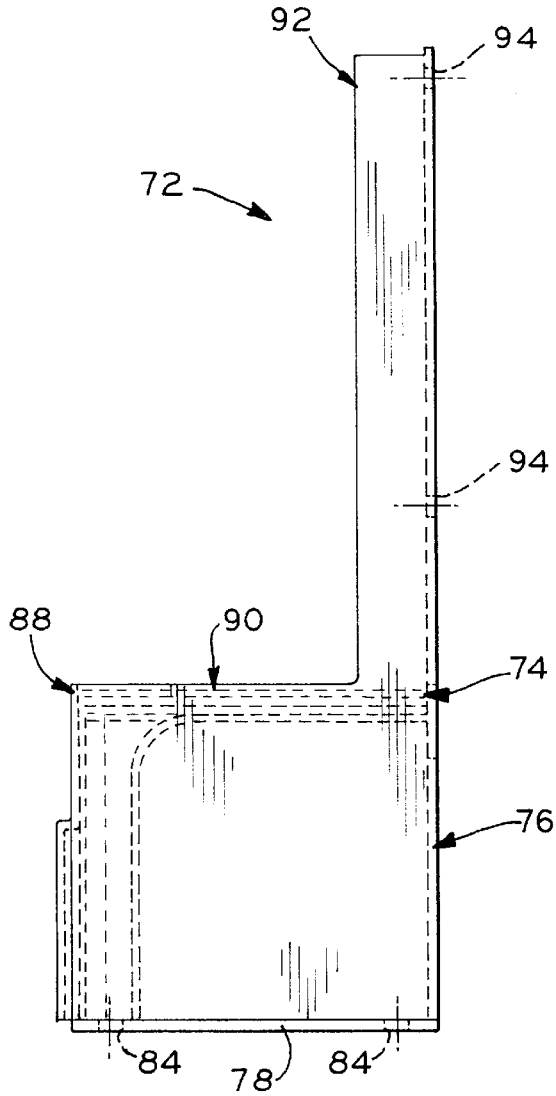
FIG. 9 is an end view of the evaporator mount of FIG. 8.

As shown in FIGS. 3, 4, and 5, fan mount 106 is integrally formed in base plate 32 to mount fan 40 beneath evaporator 36. Located adjacent fan mount 106 are airflow passageways 108 formed in base plate 32. Air enters and exits chamber 110 defined by evaporator cover 44 through airflow passageways 108 where it is cooled by evaporator 36. The cooled air then refrigerates appliance 20.

The airflow path through refrigeration apparatus 20 is illustrated in FIG. 1A. The temperature of the air within compartment 30 of apparatus 20 increases as heat from the objects being cooled, located in compartment 30, is transferred to the air. The objects in compartment 30 are thus cooled. The warmed air exits compartment 30 in the direction of arrows 144 through first warm air chamber 152 located in top wall 148 of compartment 30. The warmed air in chamber 152 passes through airflow passageways 108 formed in base plate 32 to enter chamber 110 defined by evaporator cover 44. The warmed air flows in the direction of arrows 144 through evaporator 36. As the warm air flows over coils 142 of evaporator 36, heat is transferred from the air to the refrigerant through the coils, thus reducing the temperature of the air. The cooled air flows from evaporator 36 in the direction of arrows 156 and by the force of fan 40 through aperture 158 in base 32 over which fan 40 is mounted. The cooled air enters second chamber 154 formed in top wall 148 being separated from warm air chamber 152 by baffle 150. The cooled air then passes into duct 162 defined by side wall 164 of compartment 30 and louvered wall 166. The cooled air flows along duct 162, exiting into the interior of compartment 30 through a plurality of spaced openings 168 formed in louvered wall 166.

Figure 12:
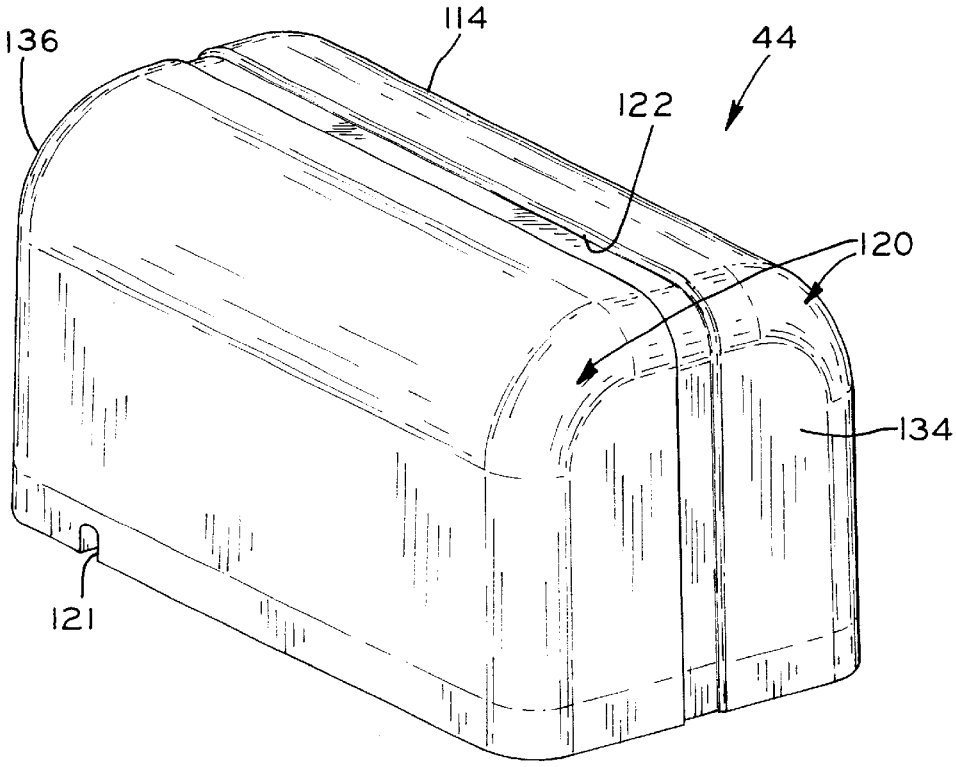
FIG. 12 is a perspective view of an evaporator cover of the modular refrigeration system of the present invention.
Figure 15:
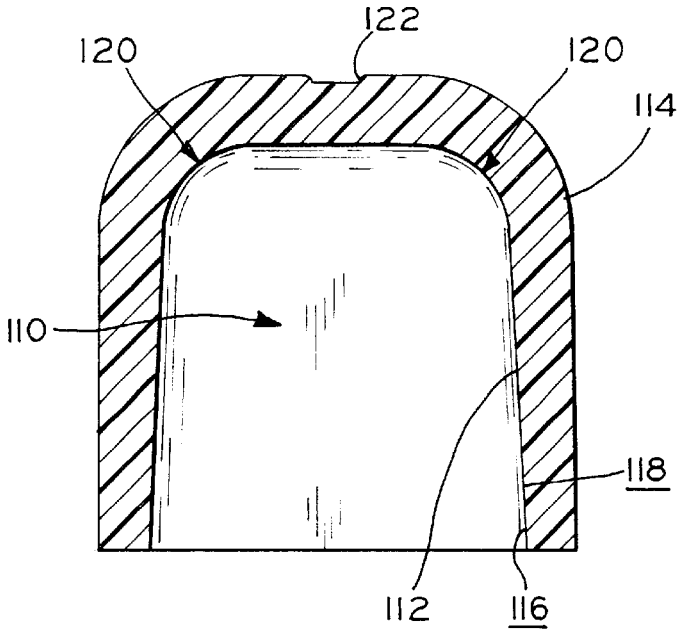
FIG. 15 is a sectional view of the evaporator cover of FIG. 14 taken along line 15—15.

Referring to FIGS. 12, 13, 14, and 15, cover 44 is constructed from a first layer 112 and a second layer 114. First layer 112 is in direct contact with refrigerated air circulating in chamber 110 defined by cover 44. Layer 112 is formed from any suitable material including plastic by a method such as injection molding. Inner surface 116 of first layer 112 is smooth to prevent turbulence in the circulating refrigerated air as it comes into contact therewith. Secured to outer surface 118 of first layer 112 is second layer 114. Second layer 114 is molded from an insulative foam material and may have a variable thickness. In order to fit the entire refrigeration system 22 onto base plate 32, the thickness of insulating layer 114 can be varied in certain areas. As illustrated in FIGS. 12 and 15, first and second layers 112 and 114 are provided with large radii 120. Radii 120 direct the airflow in chamber 110 smoothly through evaporator 36, thus improving the system efficiency. Opening 121 is provided in one side of cover 44 through which conduit 46 and expansion device 39 passes to connect with evaporator 36.

Figure 13:
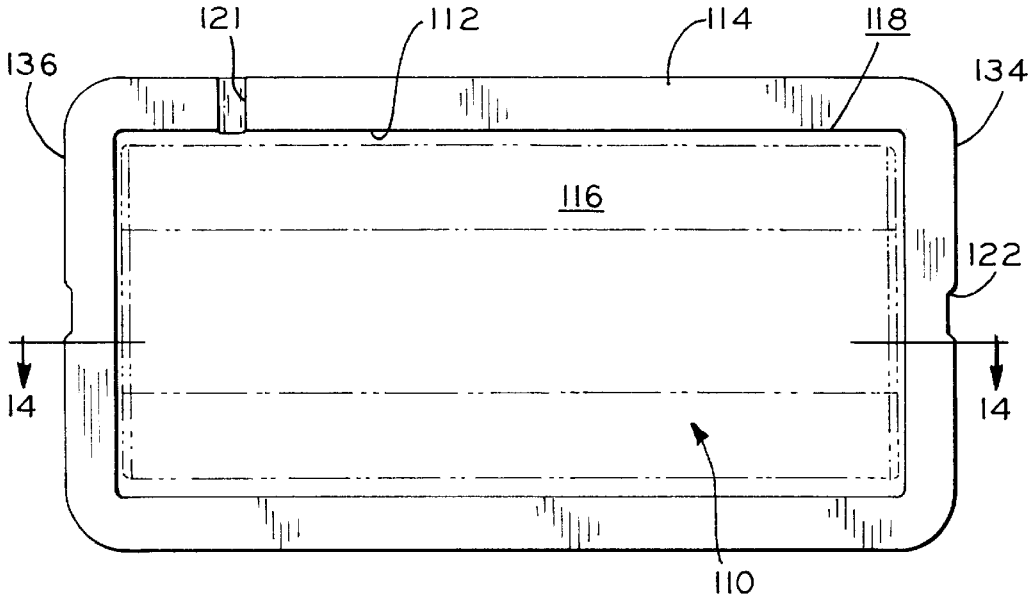
FIG. 13 is a bottom plan view of the evaporator cover of FIG. 12.
Figure 14:
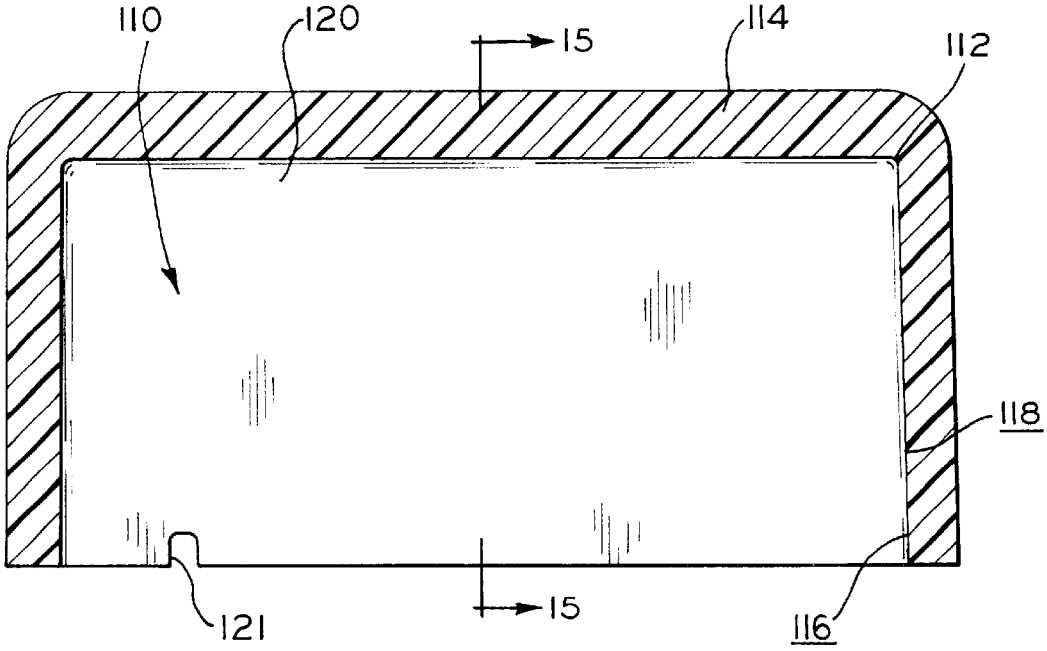
FIG. 14 is a sectional view of the evaporator cover of FIG. 13 taken along line 14—14.

As illustrated in FIGS. 12, 13, and 15, cover 44 is provided with mounting means including longitudinal groove 122 formed in the outer surface of insulative layer 114 and projections 124 molded into base plate 32 (FIG. 4). Projections 124 engage first layer 112 of cover 44 and are provided for properly locating cover 44 on base plate 32 over evaporator 36 and airflow passageway 108. Cover 44 is secured against gasket 125 located between base plate 32 and cover 44 by elastic fastener 126 (FIG. 2) received in groove 122. Elongated elastic fastener 126 may be a rubber band or any other suitable elastic member which retains cover 44 against base plate 32 by means of its self-tensioning, elastic properties. Fastener 126 is secured to hooks 128 integrally formed on respective opposite sides 130 and 132 of base plate 32 (FIGS. 2, 4, and 5). Hooks 128 are located in recesses 131 in sides 130 and 132 so as not to extend past the width of base plate 32. Groove 122 in ends 134 and 136 of cover 44 align with recesses 131. Fastener 126 is then looped over respective hooks 128 to secure cover 44 onto base plate 32.

The general operation of refrigeration system 22 includes first supplying power to operate the motor of compressor 38, condenser fan 35, and fan 40. The refrigerant gas in the system enters compressor 38 where it is compressed, pressurizing the gas and thus increasing the temperature. The heated refrigerant gas travels through compressor discharge conduit 138 (FIG. 2) and enters heat exchanger coils 140 of condenser assembly 34 where the gas is condensed to a liquid state. A portion of discharge conduit 138 is located in drain pan 64 where the heat of the refrigerant gas within the conduit assists with the rapid boil off of condensate collected in drain pan 64. The heat of the gas entering condenser coils 140 is conducted to the ambient air as condenser fan 35 blows air across coils 140. The heated air then travels over condensate drain pan 64 to further help with the evaporation process of condensate in pan 64. From the condenser, the liquid refrigerant flows through expansion device 39 which reduces the pressure of the refrigerant as it enters evaporator 36. The refrigerant is boiling as it flows through heat exchanger coils 142 of evaporator 36 causing it to evaporate. Air is blown across coils 142 by fan 40 and the heat from the air is transferred to coils 142, thus reducing the temperature of the air as it is forced over evaporator 36. The cool air then creates the refrigerated environment of appliance 20.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A modular refrigeration system having an evaporator, a condenser, and a compressor fluidly connected by a plurality of conduits, the modular refrigeration system, comprising:

a one-piece base plate, the evaporator, condenser, and compressor mounted to said base plate;

a compressor mount formed in said base plate, said compressor mount including at least one integrally formed stud extending therefrom, the compressor having at least one mounting flange, said stud received in an aperture formed in said mounting flange; and a fastener affixed to said stud, whereby said compressor is secured to said base plate; and a drain pan integrally formed in said base plate said drain pan located beneath said compressor, condensate collected in said drain pan, said compressor mount is located in said drain pan; and the condenser having a fan, said fan directing air over said drain pan and the condensate evaporates.

2. The refrigeration system of claim 1, wherein said compressor mount further includes a boss, said stud integrally formed with said boss, said boss extending a distance above said drain pan, whereby said compressor is seated substantially above said drain pan.

3. The refrigeration system of claim 1, wherein the compressor further includes a discharge tube, at least a portion of said discharge tube located in said drain pan, whereby the condensate evaporates.

4. The refrigeration system of claim 1, wherein said base plate further includes a drain basin integrally formed therein, said drain basin located beneath the evaporator, said drain basin fluidly connected to said drain pan.

5. The refrigeration system of claim 1, wherein said base plate further includes a fan mount integrally formed therein, said fan mount located beneath the evaporator.

6. A modular refrigeration system having an evaporator, a condenser, and a compressor fluidly connected by a plurality of conduits, the modular refrigeration system, comprising:

a one-piece base plate, the evaporator, condenser, and compressor mounted to said base plate;

a drain pan integrally formed in said base plate, said drain pan located beneath the compressor, the compressor including a discharge tube at least a portion of the discharge tube located in said drain pan, heat from the discharge tube promoting evaporation of condensate in said drain pan; and a drain basin integrally formed in said base plate located beneath the evaporator, said basin and said drain pan fluidly connected such that condensate collects in said drain pan.

7. The refrigeration system of claim 6, further comprising a channel integrally formed in said base plate, said channel fluidly connecting said basin and said drain pan.

8. A modular refrigeration system having an evaporator, a condenser, and a compressor fluidly connected by a plurality of conduits, the modular refrigeration system, comprising:

a one-piece base plate, the evaporator, condenser, and compressor mounted to said base plate;

a drain pan integrally formed in said base plate, said drain pan located beneath the compressor;

a drain basin integrally formed in said base plate located beneath the evaporator, said basin and said drain pan fluidly connected such that condensate collects in said drain pan; and wherein the condenser further includes a fan directing air over the drain pan, whereby heated air directed over said drain pan by said fan promotes evaporation of condensate in said drain pan.

9. The refrigeration system of claim 8, wherein the compressor further includes a discharge tube, at least a portion of said discharge tube located in said drain pan, whereby heat from the discharge tube promotes evaporation of condensate in said drain pan.

10. A modular refrigeration system having an evaporator, a condenser, and a compressor fluidly connected by a plurality of conduits, the modular refrigeration system, comprising:

a one-piece base plate, the evaporator, condenser, and compressor mounted to said base plate;

a drain pan integrally formed in said base plate, said drain pan located beneath the compressor, condensate collecting in said drain pan, the condenser further including a fan, whereby said fan directs air over said drain pan and the condensate evaporates;

a fan mount integrally formed in said base plate, said fan mount located beneath the evaporator;

at least one airflow passageway located in said base plate;

a cover mounted to said base plate encasing the evaporator, said fan mount and said airflow passageway located beneath said cover.

11. The refrigeration system of claim 10, further comprising a drain basin integrally formed in said base plate, said drain basin located beneath the evaporator and said cover.

12. The refrigeration system of claim 11, wherein said drain basin is fluidly connected to said drain pan, condensate from the evaporator collected in said drain basin and directed to said drain pan.

13. The refrigeration system of claim 10, wherein the compressor further includes a discharge tube, at least a portion of said discharge tube located in said drain pan, whereby heat from the discharge tube promotes evaporation of condensate in said drain pan.

14. The refrigeration system of claim 10, further comprising a chamber defined by said cover, air flowing into said chamber via a first said airflow passageway and out of said chamber via a second said airflow passageway.

15. A modular refrigeration system having an evaporator, a condenser, and a compressor fluidly connected by a plurality of conduits, the modular refrigeration system, comprising:

a one-piece base plate, the evaporator, condenser, and compressor mounted to said base plate;

at least one projection integrally formed with said base plate;

a cover mounted to said base plate encasing the evaporator, said cover engaged by said projection;

a groove formed in said cover;

a recess formed in each of opposite sides of said base plate, said recesses aligned with said groove;

a hook located in each of said recesses; and an elastic fastener received in said groove and engaging each said hook, whereby said cover is secured to said base plate by said fastener.

16. The refrigeration system of claim 15, wherein said cover includes a first inner layer and a second outer layer, said first layer in contact with air in the system and said second layer secured to said first layer.

17. The refrigeration system of claim 16, wherein said second layer is constructed from an insulative material.

18. The refrigeration system of claim 15, further comprising a gasket located between said base plate and said cover.

19. The refrigeration system of claim 15, wherein said cover further includes radii sized to prevent turbulent airflow beneath said cover.

20. The refrigeration system of claim 15, wherein said elastic fastener is a rubber band.

21. A method of attaching a cover for an evaporator to a base plate of a modular refrigeration system, comprising:

engaging the cover with projections extending from the base plate;

engaging a first hook formed on a first side of the base plate with an elastic fastener;

locating the elastic fastener in a groove formed in the cover; and engaging a second hook formed on a second, opposite side of the base plate with the elastic fastener, whereby the cover is secured to the base plate.

* * * * *

UNITED STATES PATENT AND TRADEMARK OFFICE

CERTIFICATE OF CORRECTION

PATENT NO. : 6,701,739 B2
APPLICATION NO. : 10/167919
DATED : March 9, 2004
INVENTOR(S) : Robert L. Morse It is certified that error appears in the above-identified patent and that said Letters Patent is hereby corrected as shown below:

Claim 1, Column 7, Line 56, delete “and” and insert --whereby--.

Signed and Sealed this
Twenty-first Day of June, 2011

David J. Kappos

David J. Kappos
*Director of the United States Patent and Trademark Office*